United States Patent [19]

Harada

[11] 4,327,682

[45] May 4, 1982

[54] FUEL SUPPLY SYSTEM FOR AN INTERNAL COMBUSTION ENGINE

[75] Inventor: Susumu Harada, Oobu, Japan

[73] Assignee: Nippondenso Co. Ltd., Kariya, Japan

[21] Appl. No.: 215,470

[22] Filed: Dec. 11, 1980

Related U.S. Application Data

[63] Continuation of Ser. No. 84,280, Oct. 12, 1979, which is a continuation of Ser. No. 829,546, Aug. 31, 1977, abandoned.

[30] Foreign Application Priority Data

Aug. 31, 1976 [JP] Japan ..... 51-117531

[51] Int. Cl.[3] ..... F02M 51/00

[52] U.S. Cl. ..... 123/326; 123/493; 123/492

[58] Field of Search ..... 123/445, 446, 493, 492, 123/326

[56] References Cited

U.S. PATENT DOCUMENTS

| | | | |
|---|---|---|---|
| 2,868,182 | 1/1959 | Cornelius | 123/326 |
| 2,879,756 | 3/1959 | Cornelius | 123/326 |
| 3,690,305 | 9/1972 | Shimada et al. | 123/326 |
| 3,703,162 | 11/1972 | Dono | 123/326 |
| 3,742,920 | 7/1973 | Black | 123/326 |
| 3,835,825 | 9/1974 | Baxendale et al. | 123/326 |
| 4,094,274 | 6/1978 | Harada et al. | 123/326 |

*Primary Examiner*—Raymond A. Nelli

*Attorney, Agent, or Firm*—Edwin E. Greigg

[57] ABSTRACT

A fuel supply system for an internal combustion engine which includes sensors that signal the condition of engine braking (negative output torque) and which shut off fuel during such a condition. According to the invention, there is provided a special circuit which recognizes the termination of the fuel shut-off phase during engine braking and which causes excess fuel to be admitted to the engine just after the resumption of fuel supply after engine braking. The excess fuel is supplied in order to overcome fuel starvation due to condensation of fuel on induction tube walls which had cooled off during overrunning. The special fuel boost circuit receives information related to the air temperature and the air flow rate in the induction tube and uses it to adjust the time constant of a multivibrator which controls the amount of fuel added.

7 Claims, 2 Drawing Figures

FUEL SUPPLY SYSTEM FOR AN INTERNAL COMBUSTION ENGINE

This is a continuation, of application Ser. No. 084,280 filed Oct. 12, 1979, which is a continuation of Ser. No. 829,546 filed Aug. 31, 1977, now abandoned.

BACKGROUND OF THE INVENTION

The invention relates to a fuel supply system for a motor vehicle. More particularly, the invention relates to a fuel supply system which recognizes the engine braking (overrunning) condition of the vehicle and which includes the provision for enhancing the engine braking and fuel economy by interrupting the fuel supply during that condition. When engine braking is terminated, the fuel supply is restarted and the engine is supplied with normal fuel and will respond to accelerator pedal pressure. When the fuel supply is shut off, combustion no longer takes place in the engine and, especially during prolonged engine braking, the engine will cool off considerably. The engine temperature may drop below the condensation temperature for fuel so that after fuel supply is resumed, the fuel may at least partially condense at the interior walls of the induction tube and this fact may result in an insufficient or incorrect fuel-air mixture. Engine operation with a mixture which is diminished in this way results in substantial discomfort to the driver and other disadvantages. One of these disadvantages is the incorrect exhaust gas composition due to combustion at insufficient temperature, which leaves toxic components in the exhaust gas.

OBJECT AND SUMMARY OF THE INVENTION

It is thus a principal object of the invention to provide an apparatus for supplying fuel to an engine which overcomes the aforementioned disadvantages. In particular it is an object of the invention to describe a method and means for compensating for the condensation of fuel at the inner walls of the induction tube at low temperature after engine braking. It is a further object of the invention to provide a fuel supply system which insures rapid re-heating of the engine due to an increased supply of fuel after engine braking. As a result of these steps and means, there is obtained an increased driver comfort in the transition from engine braking to normal operation and the emission of toxic components in the exhaust gas is greatly reduced due to the rapid engine heating.

The invention will be better understood as well as further objects and advantages thereof become more apparent from the ensuing detailed description of three preferred embodiments taken in conjunction with the drawing.

DESCRIPTION OF THE PREFERRED EMBODIMENT

Figure 1:
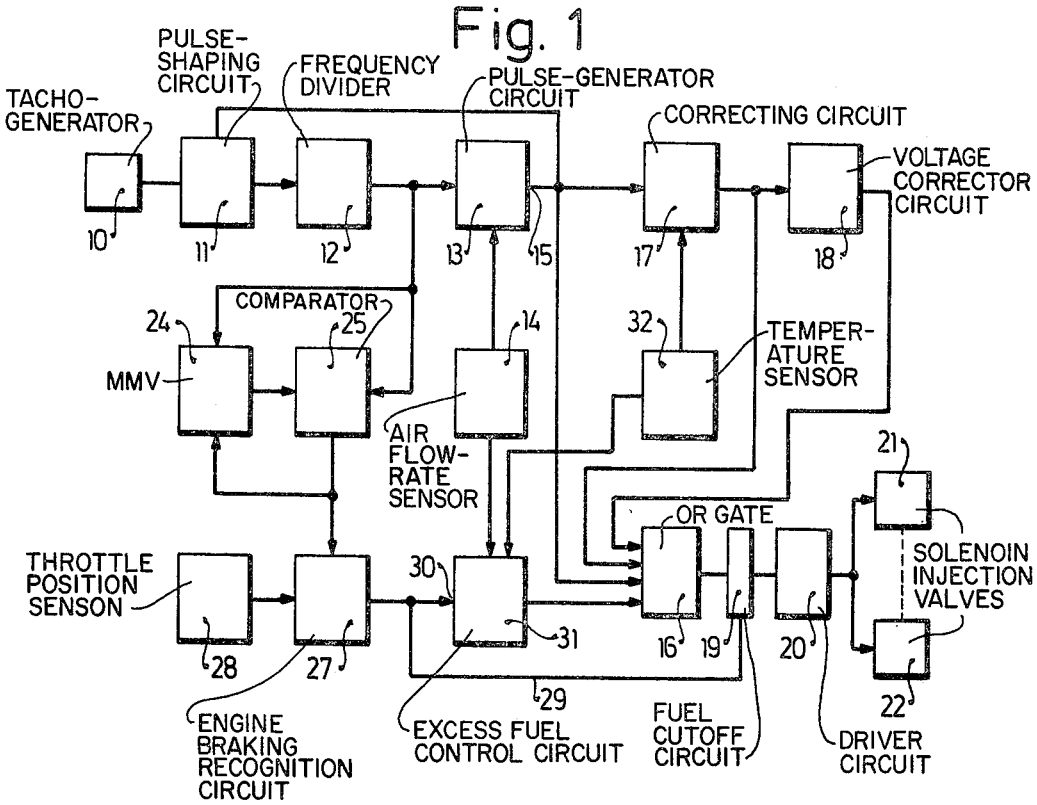
FIG. 1 is a block diagram of an electronic fuel supply system according to the present invention.

Turning now to FIG. 1, there is seen the block diagram of the electronic circuitry which is part of a fuel injection system, not shown in detail, to be used in an engine, not shown, of a motor vehicle, not shown.

The element 10 is tacho-generator which supplies a signal related to engine rpm and whose output is connected to a pulse shaping circuit 11, a frequency divider 12 and a pulse generator circuit 13. An air flow rate sensor 14 of the type shown and described in U.S. Pat. No. 3,750,631 supplies a signal to the pulse generator circuit 13. The output 15 of the circuit 13 is connected to an OR gate 16, a correcting circuit 17 and back to the pulse shaping circuit 11. The latter connection insures that the duration of the output signal from the pulse generating circuit 13 is never greater than the duration of the pulse from the pulse shaping stage 11, as will be explained below. The OR gate 16 also receives the output signals of the correcting circuit 17 which supplies a pulse correction on the basis of signals related to engine temperature and further on the basis of signals related to a desired excess fuel quantity which represents the heart of the invention and will be described in greater detail below. The OR gate 16 also receives the output of a voltage correcting circuit 18. Both the correcting circuit 17 and the voltage correcting circuit 18 are of the type shown and described in U.S. Pat. No. 3,483,851. Connected behind the OR gate 16 is an AND gate 19 which controls a driver circuit 20 which directly actuates the solenoid injection valves 21 and 22.

The output signal from the frequency divider 12 is fed to a monostable flip-flop 24 and to a comparator 25 and the output of the flip-flop 24 goes to a second input of the comparator 25 whose own output is returned to one of the inputs of the monostable multivibrator. The circuit further includes an engine braking recognition circuit 27 which is embodied as an AND gate receiving the output of the comparator 25 as well as a signal from a throttle position sensor 28. The output of the engine braking recognition circuit 27 is fed via a first line 29 to the fuel cut-off circuit 19 and via a second line 30 to an excess fuel circuit 31. The excess fuel circuit 31 also receives the signal from the output of the air flow rate sensor 14 and from a temperature sensor 32.

The overall operation of the circuit described above is as follows:

The signals generated by the tacho-generator 10 are shaped in the pulse shaping stage 11 which operates as a monostable multivibrator and are divided in the frequency divider 12. The output signals of the frequency divider and the signals from the air flow rate meter 14 are used in the pulse generating circuit 13, which may be of known construction, to produce fuel injection control pulses whose width is changed in the subsequent corrector circuit 17 as a function of engine temperature. These pulses are further corrected in the voltage corrector unit 18 as a function of the prevailing vehicle voltage. The OR gate 16 serves to select the longest of the pulses which are available, respectively, from the pulse generator circuit 13, the corrector circuit 17 and the voltage corrector circuit 18. The longest of these pulses is fed to the fuel shut-off circuit 19 which is an AND gate and whose output signal in turn affects the driver circuit 20 and thus serves as a control signal for the two electromagnetic injection valves 21 and 22.

The output signal of the frequency divider 12 is fed to the monostable flip-flop 24 and to the comparator 25 which performs a comparison of the length of the signals from the divider 12 and from the monostable flip-flop 24. The output signal from the comparator 25 is used to form a variable unstable time constant for the monostable flip-flop 24 and serves at the same time as one of the input signals for the engine braking recognition circuit 27. The comparator circuit 25 is built so that, if the duration of the unstable state of the monostable flip-flop 24 is smaller than the duration of the output signal of the frequency divider, the comparator produces a low level output voltage. In the opposite case, i.e., if the duration of the unstable state of the monostable multivibrator 24 is longer than the pulse width of the signal from the frequency divider 12, i.e., at high engine rpm, the comparator output is at a high potential. The duration of the unstable state of the monostable multivibrator 24 is so chosen as to correspond with that period of the frequency divider signal which is desired to be the limit at which fuel is shut off for a given throttle valve position.

When the throttle opening is less than a desired angle, the throttle valve shaft encoder 28 produces a positive signal so that the recognition circuit 27 which contains a NAND gate produces a low output if the engine speed is greater than a certain value and if, at the same time, the throttle valve angle is less than a previously determined value. In the simplest case, the throttle valve position sensor or shaft encoder 28 is embodied to generate a high, i.e., positive, signal when the throttle valve is closed, so that the recognition circuit 27 produces a low output signal when the engine rpm is greater than a certain value and the throttle valve is closed at the same time.

If the output of the engine braking recognition circuit 27 is a logical 0 (low level) this signal, which is present on the line 29, prevents the injection control signals coming from the OR gate 16 to reach the driver circuit 20 due to the fact that the AND gate in the fuel shut-off circuit 19 is blocked. The injection valves thus receive no power and remain closed, thereby preventing fuel supply to the engine until the engine speed has dropped below a certain value and the output of the engine braking recognition circuit 27 is a logical 0 (low level).

When engine braking, i.e., overrunning, has ceased, the output of the recognition circuit 27 becomes a logical high, thereby causing the fuel shut-off circuit 19 to transmit the output signals from the OR gate 16 to the driver circuit 20 and thereby actuating the electromagnetic injection valves 21 and 22. At the same time, the increase of the voltage at the output of the engine braking recognition circuit 27 causes the excess fuel circuit 31 which contains a timing element such as a monostable multivibrator to provide a pulse of definite length to the OR gate 16 and thus also to the output driver circuit 20.

Preferably, the monostable multivibrator within the excess fuel control circuit 31 responds only to positive-going edges of the output signal from the overrunning recognition circuit 27. However, even if it also responds to negative going edges, no harm is done because, when the line 29 carries a low level signal, any pulses which reach the OR gate 16 are unable to pass the fuel shut-off circuit 19 which acts as an AND gate.

In order to adjust the desired excess fuel quantity which is supplied at the termination of the overrunning condition on the basis of the prevailing operational state so as to optimize the engine performance, it has been found to be advantageous to make the time constant of the monostable multivibrator within the excess fuel circuit 31 dependent on the temperature and the air flow rate in the induction tube. Monostable multivibrators whose time constant may be adjusted externally to change the unstable state are sufficiently known in the literature and will not be discussed further.

Figure 2:
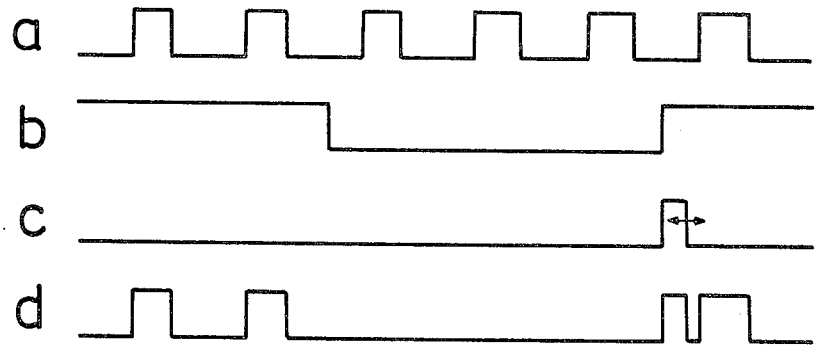
FIG. 2 is a pulse diagram describing the voltages encountered in the circuit of FIG. 1.

FIG. 2 is a set of timing diagrams illustrating the electrical pulses prevailing in various portions of the block circuit diagram of FIG. 1. FIG. 2*a* shows the output signal of the OR gate 16 caused by the output signals from the pulse generator circuit 13, the correcting circuit 17 and the voltage correcting circuit 18. This pulse train, however, does not include the contribution from the excess fuel control circuit 31.

FIG. 2*b* is a diagram showing the output signal from the overrunning recognition circuit 27 in which that condition represents a low level signal.

FIG. 2*c* illustrates the output signal from the monostable multivibrator within the excess fuel control circuit 31 and this multivibrator is triggered only for a positive-going edge of the output signal from the circuit 27. The two-way arrow in the negative going edge of the pulse shown in FIG. 2*c* indicates that the pulse width, which is related to the unstable state of the monostable multivibrator, is variable and may depend on temperature and the air flow rate in the induction tube.

FIG. 2*d* illustrates the output signal of the fuel shut-off circuit 19 and thus also represents the control signal for the two electromagnetic injection valves 21 and 22. This diagram illustrates that the pulses are suppressed during the overrunning operation and that an additional injection pulse is added directly after the termination of the overrunning condition.

The fuel supply system described and illustrated above permits increasing the injected fuel quantity for a definite length of time after the overrunning operation is terminated. As a consequence, any undesirable results due to insufficient fuel injection are thereby eliminated. In particular, any detraction from the comfort of the passengers is avoided as is an increase in the toxicity of the exhaust gases after engine braking, i.e., overrunning operation. It should be noted that, while the exemplary embodiment described and illustrated relates to a fuel injection system for an internal combustion engine, the general principle of increasing the fuel quantity subsequent to engine braking can also be used for those engines which employ carburetors inasmuch as the same physical processes occur in such an engine after engine braking as those which occur in engines equipped with a fuel injection system.

The foregoing relates to a preferred exemplary embodiment of the invention, it being understood that other embodiments and variants thereof are possible within the spirit and scope of the invention.

What is claimed and desired to be secured by Letters Patent of the United States is:

1. A fuel supply system for use with an internal combustion engine, comprising:

an engine acceleration sensor;

at least one other sensor for sensing another engine operating parameter;

a fuel metering apparatus, to which said sensors are connected and to which said sensors supply signals indicative of the engine operating parameter sensed, said fuel metering apparatus providing an output signal for metering a quantity of fuel for delivery to the engine in accordance with the signals received from the sensors;

a fuel cutoff circuit connected to receive the output signal from the fuel metering apparatus;

an engine braking recognition circuit connected to the fuel cutoff circuit and supplying thereto a signal associated with an engine braking condition, said fuel cutoff circuit interrupting the output signal from the fuel metering apparatus, and therefore fuel metering to the engine, when the signal from the engine braking recognition circuit indicates than engine braking condition exists; and an additional fuel quantity control circuit connected to the engine braking recognition circuit and to the fuel metering apparatus, said additional fuel quantity control circuit providing a signal to the fuel metering apparatus when the signal from the engine braking recognition circuit indicates that an engine braking condition is terminated so that the fuel metering apparatus provides an output signal for initially metering a quantity of fuel for delivery to the engine in accordance with the signal received from the additional fuel quantity control circuit and thereafter metering a quantity of fuel for delivery to the engine in accordance with the signals received from the sensors.

2. The fuel supply system as defined in claim 1, wherein the additional fuel quantity control circuit includes a timing element.

3. The fuel supply system as defined in claim 2, wherein said at least one other sensor comprises an air flow rate meter and a temperature sensor, said air flow rate meter and said temperature sensor being connected to the additional fuel quantity control circuit for supplying signals indicative of air flow rate and engine temperature, respectively, to the additional fuel quantity control circuit, said latter signals serving to influence the timing element.

4. The fuel supply system as defined in claim 1, further comprising:

at least one electromagnetic injection valve connected to the fuel cutoff circuit, wherein the fuel metering apparatus includes pulse generating means to which the sensor signals are applied, the output of which is to be applied to said at least one electromagnetic injection valve through the fuel cutoff circuit.

5. The fuel supply system as defined in claim 4, further comprising:

a drive circuit connected between the fuel cutoff circuit and said at least one electromagnetic injection valve.

6. The fuel supply system as defined in claim 1, further comprising:

a throttle position sensor connected to the engine braking recognition circuit; and a comparator circuit connected to the engine acceleration sensor and the engine braking recognition circuit, said engine braking recognition circuit serving as on AND gate for the signals from the throttle position sensor and the comparator circuit.

7. The fuel supply system as defined in claim 1, further comprising:

a pulse shaping circuit connected to the engine acceleration sensor;

a frequency divider circuit connected to the pulse shaping circuit; and a pulse generating circuit connected to the frequency divider circuit, wherein the output of the pulse generating circuit is connected to the pulse shaping circuit.

* * * * *